United States Patent [19]

Konrath et al.

[11] Patent Number: 4,884,542

[45] Date of Patent: Dec. 5, 1989

[54] FUEL-INJECTION PUMP FOR INTERNAL COMBUSTION ENGINES, IN PARTICULAR FOR DIESEL ENGINES

[75] Inventors: Karl Konrath, Freiberg; Claus Koester, Ditzingen; Karl Zibold, Asperg; Manfred Schwarz, Gerlingen; Karl-Friedrich Russeler, Ditzingen; Klaus Krieger, Affalterbach; Roland Kupzik, Stuttgart, all of Fed. Rep. of Germany

[73] Assignee: Robert Bosch GmbH, Stuttgart, Fed. Rep. of Germany

[21] Appl. No.: 280,864

[22] Filed: Dec. 7, 1988

[30] Foreign Application Priority Data

Dec. 9, 1987 [DE] Fed. Rep. of Germany ..... 3741638

[51] Int. Cl.[4] ..... F02M 39/00

[52] U.S. Cl. ..... 123/370; 123/373; 123/365

[58] Field of Search ..... 123/373, 365, 370, 387, 123/379, 388, 371

[56] References Cited

U.S. PATENT DOCUMENTS

| | | | |
|---|---|---|---|
| 3,640,258 | 2/1972 | Isobe | 123/365 |
| 3,797,470 | 3/1974 | Beck | 123/373 |
| 3,886,922 | 6/1975 | Frick | 123/365 |
| 4,180,040 | 12/1979 | Hofer | 123/373 |
| 4,328,777 | 5/1982 | Yasuhara | 123/370 |
| 4,368,406 | 1/1983 | Yasqhara | 123/370 |
| 4,426,971 | 1/1984 | Isoda | 123/373 |
| 4,498,437 | 2/1985 | Ohkoshi | 123/365 |
| 4,505,241 | 3/1985 | Eheim | 123/373 |
| 4,612,891 | 9/1986 | Doveri | 123/373 |
| 4,664,029 | 5/1987 | Sakuranaka | 123/373 |

*Primary Examiner*—Carl Stuart Miller
*Attorney, Agent, or Firm*—Edwin E. Greigg

[57] ABSTRACT

In a fuel injection pump for internal combustion engines for motor vehicles, a damping device is provided to eliminate so-called vehicle bucking. The device allows rapid adjusting movements of an rpm adjusting lever, which is connected to the driving lever, to affect the supply quantity setting of the fuel injection pump only with a delay. To this end, the damping device has a damping chamber defined by a damping cylinder and a damping piston displaceable therein. The damping chamber communicates with the pump interior via two parallel throttles and via counter-parallel check valves located in series with the parallel throttles. The damping piston is connected to a damper lever on which the rpm adjusting lever is supported via a pre-stressed drag spring. The damper lever is connected via a governor spring to a governor lever, which actuates a quantity adjusting device to determine the fuel metering, so that an adjusting motion of the rpm adjusting lever acts upon the quantity adjusting device only in a delayed manner.

20 Claims, 1 Drawing Sheet

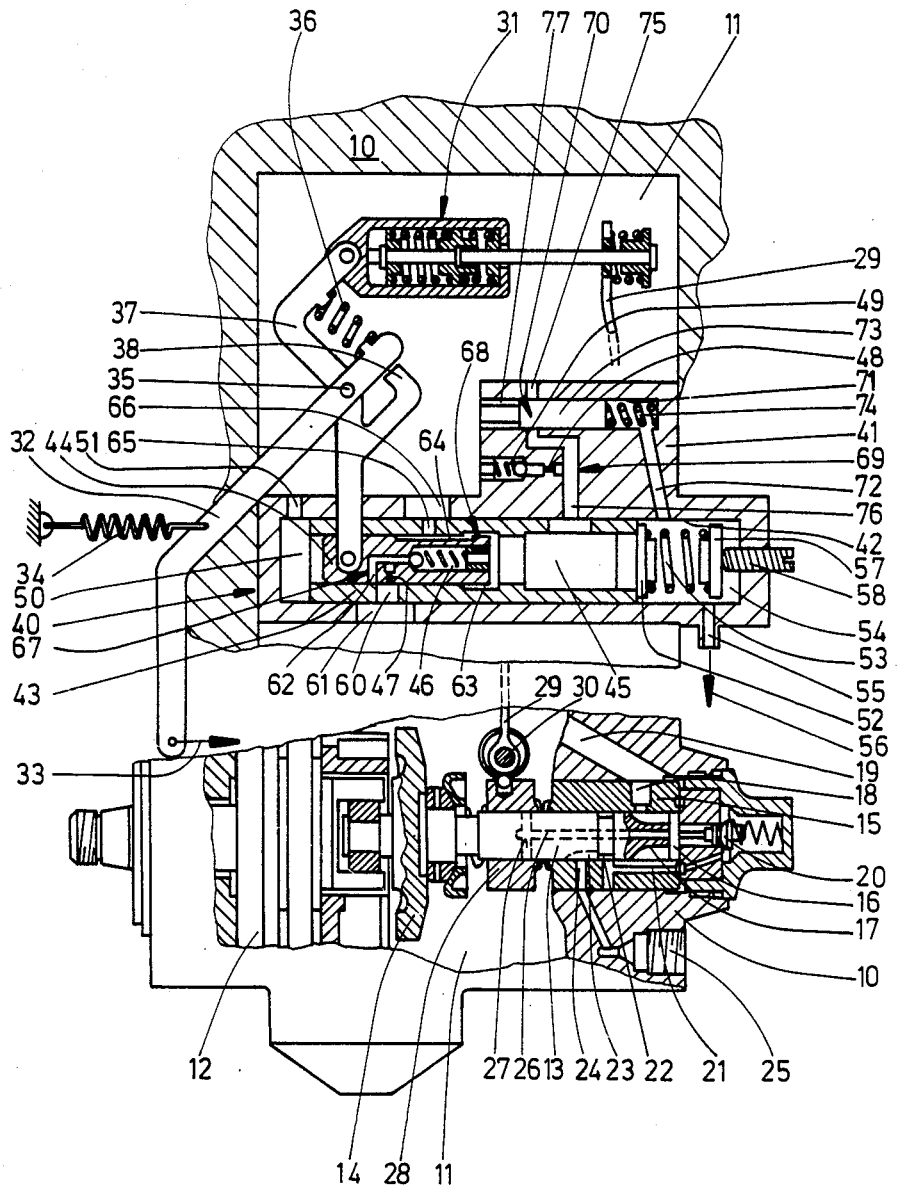
36
31
77
70
75
11
10
29
49
73
48
71
74
41
69
72
76
42
57
58
54
53
55
52
56
19
18
15
20
16
17
10
25
21
22
23
24
13
26
27
12
14
28
11
37
38
35
66
32
44
51
65
64
68
34
50
40
67
43
62
61
60
47
46
63
29
30
45
33

FUEL-INJECTION PUMP FOR INTERNAL COMBUSTION ENGINES, IN PARTICULAR FOR DIESEL ENGINES

BACKGROUND OF THE INVENTION

The invention relates to a fuel injection pump for internal combustion engines, in particular for Diesel engines, as defined hereinafter.

A considerable disadvantage of passenger cars equipped with Diesel engines is what is known as bucking at low rpm; bucking occurs not only at full load and partial load but also at low rpm, primarily when accelerating and decelerating, when the driving pedal is actuated quickly. Vehicle bucking is largely precluded in Diesel engines that have fuel injection pumps by equipping them also with damping devices, which allow changes in the fuel injection quantities, effected by the fuel injection pump when the driver "steps on the gas" or "lets up on the gas" quickly, to come into effect only after a delay.

In a known fuel injection pump of the above generic type (German Offenlegungsschrift 34 27 224), the hydraulic damping device is disposed between the pump rpm adjusting lever which is coupled to the driving lever, and the vehicle body; the damping cylinder is connected to the body, while the damping piston is joined via a piston rod to the rpm adjusting lever. A throttle by which two damping chambers located on opposite ends of the piston communicate is disposed in a longitudinally continuous axial bore of the damping piston. The rpm adjusting lever is mounted for rotation with a pivotable adjusting shaft in the housing of the fuel injection pump and a lever is rigidly secured on the end of this shaft that protrudes into the pump interior. The lever is engaged by the governor spring connected to the governor lever. The driving pedal engages the rpm adjusting lever via compression springs. Upon quick actuation of the driving pedal, the rpm adjusting lever follows its action only with a delay, because it is supported on the body via the damping device. With increasing torque, the engine, mounted on the body by means of resilient buffers, leans to one side about its longitudinal axis In this process, the rpm adjusting level is supported on the body via the damping device and is pivoted in the direction for reduction of the fuel injection quantity. Conversely, with rapidly decreasing torque the engine leans to the other side, and the rpm adjusting lever is displaced by the damping device in the direction of an increasing fuel quantity. The damping device thus has a delaying effect upon "stepping on the gas", and a differentiating effect when the fuel quantity is changed by the deflection of the engine. In the opposite direction, that is, upon "letting up on the gas", the damping device functions correspondingly. With the negative feedback between the engine motion and the metered fuel quantity, vehicle bucking is actively damped. However, the damping effect is always of equal magnitude during "stepping on the gas" and "letting up on the gas", so that vehicle bucking is not optimally suppressed in all cases.

OBJECT AND SUMMARY OF THE INVENTION

The fuel injection pump according to the invention has the advantage that acceleration damping and deceleration damping are attainable individually and without idle travel in the applicable range. The two throttles enable separate setting of the acceleration damping and the deceleration damping. For both damping directions, the delay periods can be determined independently of one another both by means of the prestressed drag or restoring spring and by means of the cross section of the throttle bores, so that an optimal setting that largely precludes bucking can be assured.

An advantageous embodiment of the invention is attained if unthrotled flow paths between the damping chamber and the pump interior are located parallel to the throttles, such that they are made available only in the regions of the damping piston displacement path in which idle travel of the rpm adjusting lever occur, or in other words in the regions of the rpm adjusting piston pivoting in which injection does not yet take place. In this way, the response behavior of the fuel injection pump in terms of the avoidance of vehicle bucking is still further improved.

A particularly advantageous embodiment of the invention will also be appreciated by those skilled in this art as the description progresses. At higher engine rpm, with the associated increase in pressure in the pump interior, the pressure valve opens, and makes a further unthrottled flow path available between the damping chamber and the pump interior. As a result, the damping device is automatically made inoperative at higher rpm, because vehicle bucking does not occur in this rpm range because of the high kinetic energy of the centrifugal masses, and so damping is unnecessary.

The invention will be better understood and further objects and advantages thereof will become more apparent from the ensuing detailed description of a preferred embodiment taken in conjunction with the drawing.

BRIEF DESCRIPTION OF THE DRAWING

The single figure of the drawing schematically shows a detail of the new fuel injection pump for a Diesel engine.

DESCRIPTION OF THE EXEMPLARY EMBODIMENT

The fuel injection pump shown only in part and schematically in FIG. 1 is of the distributor type and is known per se (see German Offenlegungsschrift 34 27 224, FIG. 2). It has a pump housing 10 that surrounds a pump interior 11. The pump interior 11 is filled with fuel by means of a feed pump 12. The pump interior 11 is at a pressure of from 6 to 8 bar. A pump piston 13 is set into simultaneously reciprocating and rotary motion via a cam drive 14 in synchronism with the feed pump 12. The pump piston 13 slides in a cylinder liner 15, which is seated in the pump housing 10 and with it defines a pump work chamber 16. The pump work chamber 16 can be made to communicate with the pump interior 11 via a longitudinal groove 17 in the end portion of the pump piston 13, an inlet opening 18 in the cylinder liner 15, and a conduit 19 in the pump housing 10. The pump work chamber 16 communicates via a pressure valve 20 and a conduit 2[with an annular conduit 22 in the pump piston 13. A distributor groove 23 branches off from the annular conduit 22 in the pump piston 13 and cooperates with outlet conduits 25, only one of which is shown, which are distributed over the circumference of the cylinder liner 15. Each outlet conduit 24 communicates with a connection opening 25 for an injection nozzle. An axial conduit 26 extends in the pump piston 13 from the pump work chamber 16 to a transverse conduit 27. The transverse conduit 27 cooperates with a quantity adjusting member 28, which is axially displaceably mounted on the pump piston portion that protrudes into the pump interior 11. As long as the transverse conduit 27 is covered by the quantity adjusting device 28, the pump piston 13 pumps fuel, which is at high pressure, out of the pump work chamber 16 into one of the outlet conduits 24, via the pressure valve 20, the conduit 21, the annular conduit 22 and the distributor groove 23. At the moment when the transverse conduit 27 emerges from the quantity adjusting device 28, the pump work chamber 16 is made to communicate with the pump interior 11 and is relieved. The high-pressure pumping to the connection openings 25 is terminated abruptly. The relative position of the quantity adjusting device 28 with respect to the pump piston 13 accordingly determines the quantity of fuel proceeding to injection via the outlet conduits 24.

For actuation of the quantity adjusting device 28, this device is engaged by a ball-like arm of a two-armed governor lever 29, which is supported on a tang 30 attached to the housing. The other arm of the governor lever 29 is engaged by a centrifugal governor (not shown) on one side and on the other side, via a governor spring 31, by an rpm adjusting lever 32, which can be pivoted arbitrarily in the direction of the arrow 33 by a driving pedal, not shown. A restoring spring 34 serves to restore the rpm adjusting lever 32 when the actuating force on the driving pedal is withdrawn. The two-armed rpm adjusting lever 32 is rotatable about a pivot shaft 35 fixed to the pump housing 10. The coupling between the rpm adjusting lever 32 and the governor spring 31 is effected via a pre-stressed drag spring 36, which is supported at one end on one lever arm of a damper lever 37 and on the other on the arm of the rpm adjusting lever 32 remote from the restoring spring 34. The pre-stressed drag spring 36 presses the lever arm of the rpm adjusting lever 32 against a stop 38, which is disposed on the lever arm of the damper lever 37 remote form the drag spring 36. The damper lever 37 itself is pivotably arranged on the pivot shaft 35 of the rpm adjusting lever 32.

The damper lever 37 is part of a damping device 40, which makes for smooth engine operation upon rapid actuation of the rpm adjusting lever 32 and eliminates so-called vehicle bucking when the driving pedal is depressed or released quickly. The hydraulic damping device 40 is disposed in the pump interior 11 and includes a damper housing 41, which has a longitudinal bore 42 that is closed at both ends; a guide sleeve 43 displaceable in the longitudinal bore 42; and a damping piston 44 sliding in the guide sleeve 43. The damper housing 41 and guide sleeve 43, in a known manner, form a damping cylinder that together with one end of the damping piston 44 defines a damping chamber 45. The damping chamber 45 communicates with the pump interior 11 on one side via a first check ventil 46 and a first throttle 47, which are both disposed in the damping piston 44, and on the other side via a second throttle 48 and a second check valve 49, which are both disposed in the damper housing 41. The communication between the outlet of the first throttle 47 and the pump interior 11 is assured by a first radial bore 60 in the guide sleeve 43 and a first radial through opening 61 in the damper housing 41. The diameter of the through opening 61 is selected to be very large in comparison with the radial bore 60, so that even which the guide sleeve 43 is displaced relative to the damper housing 41, the through opening 61 always uncovers the radial bore 60 toward the pump interior 11. The two check valves 46, 49 are disposed such that the blocking direction of the first check valve 46 is oriented toward the pump interior 11 and that of the second check valve 49 is oriented toward the damping chamber 45. The lever arm of the damper lever 37 that has the stop 38 is pivotably secured to the damping piston 44, while the lever arm of the damper lever 37 that has the prestressed drag spring 36 is coupled to the governor spring 31.

On one face end, the guide sleeve 43, together with the damping piston 44, defines a control chamber 40, which communicates via a radial inlet conduit 51 with the pump interior 11. The other face end of the guide sleeve 43 is covered with a closure plate 52, which at the same time serves as a guide for a compression spring 53. The guide sleeve 43 and the closure plate 52 define a relief chamber 54 which receives the compression spring 53 and communicates via an outlet conduit 55 with a fuel return line represented by the arrow 56. The compression spring 53 is supported on a stop plate 57, the location of which in space inside the relief chamber 54 is adjustable by means of an adjusting pin 58 that can be threaded into the damper housing 41. The initial stress of the compression spring 53 can be set by turning the adjusting pin 58 to a greater or lesser extent.

To prevent the damping device 40 from being operative in the region of the idle paths of the rpm adjusting lever 32, or in other words when injection is not yet taking place, two unthrottled flow paths are located parallel to the throttles 47, 48; in certain portions of the adjusting motion of the damping piston 44, these flow paths connect the damping chamber 45 with the pump interior 11, bypassing the two throttles 47, 48 and thus eliminating the throttling effect. Since these idle paths of the rpm adjusting lever 32 are located in different displacement regions of the damping piston 44 at various engine speeds or rpm and hence at various pump rpm, these flow paths correspondingly shift in the adjusting range of the damping piston as a result of displacement of the guide sleeve 43, which displaces to the right in the drawing, counter to the action of the compression spring 53, with increasing engine rpm and hence increasing pressure in the pump interior 11. The first flow path 67 is embodied by a bypass bore 62 that bypasses the first throttle 47 in the damping piston 44, by the first radial bore 60, forming a control opening, in the guide sleeve 43, and by the first through opening 61, corresponding with this bore 60, in the damper housing 41. The diameter of the first radial bore 60 is selected to be such that depending on the position of the damping piston 44 relative to the guide sleeve 43, only the mouth of the first throttle 47, or additionally the mouth of the bypass bore 62 from the guide sleeve 43 to the pump interior 11 as well are opened up. The second unthrottled flow path 68 between the damping chamber 45 and the pump interior 11 is embodied by an annular groove 63 in the damping chamber 45, by an axial groove 64 on the circumference of the damping piston 44 and communicating continuously with the annular groove, by a second radial bore 65 in the guide sleeve 43, and by a second through opening 66 in the damping housing 41. The diameter of the through opening 66 is selected to be so large that the second radial bore 65 in the guide sleeve 43 is opened up to the pump interior 11 over the entire displacement range of the guide sleeve 43. The annular groove 63 in the damping chamber 45 is embodied such that after a certain displacement travel of the damping piston 44, which depends on the relative position of the damping piston 44 and the guide sleeve 43, the annular groove 63 is closed off from the remainder of the damping chamber 45. The axial groove 63 in the damping piston 44 is of a length such that over the entire displacement travel of the damping piston 44, the annular groove 63 remains in communication with the second radial bore 65 in the guide sleeve 43. Depending on the displacement position of the guide sleeve 43, the damping piston 44 requires a variably long displacement travel before it closes off the annular groove 63 from the damping chamber 45—and thus blocks off the flow path 68—or opens it and hence opens up the flow path 68. Thus this flow path 68 is operative in both directions of the displacement motion of the damping piston 44, while the first unthrottled flow path 67, because of the first check valve 46 located in the flow path 67, can be operative only upon a displacement of the damping piston 44 toward the left as seen in the drawing, or in other words upon an adjustment of the rpm adjusting lever in the direction of smaller fuel supply quantities.

Vehicle bucking is perceptible primarily at low rpm and here is largely suppressed by means of the above-described damping device 40. In the higher rpm range, because of the high kinetic energy of the centrifugal masses, vehicle bucking is no longer perceptible, so that the damping device 40 becomes rather superfluous and even disadvantageous to the ride. For this reason, the damping devices 40 are switched off at higher rpm, so that their damping effect becomes zero. To this end, a third unthrottled flow path 69 is provided, which at high rpm connects the damping chamber 45 directly with the pump interior 11 and thus short-circuits the damping device 40. Below a certain rpm, the third unthrottled flow path 69 is blocked. Blocking and opening of the flow path 69 are effected by means of a pressure valve 70, which is embodied here as a slide valve. To this end, a blind bore 71 is provided in the damper housing 41, communicating near the bore bottom with the relief chamber 54 via a relief bore 72. A control piston 73 which is adapted to slide in the blind bore 71 is acted upon on its face end by the pressure in the pump interior 11 and is supported with its other face end on the bore bottom, via a compression spring 74. The third flow path 69 is embodied by two bores 75, 76 in the damper housing 41, which communicate at one end with the pump interior 11 and at the other with the damping chamber 45 and discharge in a cross-sectional plane diametrically in the blind bore 71. A separate control groove 77 on the control piston 73 communicates with each of the two mouths of the bores 75, 76 and uncovers or blocks off the passage from the bore 76 to the bore 75 in accordance with the displacement position of the control piston 73. By a suitable selection of the compression spring 74, the pressure valve 70 is set such that if a predetermined pressure in the pump interior 11 is exceeded, the control piston 73 is displaced, counter to the force of the compression spring 74, far enough that the bores 75, 76 communicate with one another and thus the damping chamber 45 is connected to the pump interior 11. Such a pressure increase does not occur in the pump interior until higher engine rpm and hence higher rpm of the feed pump 12.

OPERATION

The mode of operation of the damping device 40 described above is as follows:

If the driving pedal is depressed ("stepping on the gas"), causing the rpm adjusting lever 32 to pivot in the direction of the arrow 33, tensing the restoring spring 34, the command force is supplied via the drag spring 36 to the damping piston 44, which moves to the right as seen in the drawing. As soon as the damping piston 44 has closed off the annular groove 63 from the damping chamber 45, the second throttle 48 allows further motion of the damping piston 44 only after a delay. Thus the damping piston 44 transmits the command force to the governor lever 29, via the governor spring 31, only via a delay as well, and the governor lever 29 in turn displaces the quantity adjusting device 28 only after a delay. Thus when the rpm adjusting lever 32 is pivoted rapidly as a consequence of fast actuation of the driving pedal, the change in injection quantity is performed only in delayed fashion, so that the vehicle is accelerated without bucking. In the reverse direction, that is, when the driving pedal is released quickly, the restoring spring 34 acts via the rpm adjusting lever 32 and the stop 38 upon the damping piston 44, so that the damping piston 44 is displaced to the left as seen in the drawing. The displacement motion of the damping piston 44 is now delayed via the first throttle 47. The delayed displacement motion of the damping piston triggers only a delayed adjustment of the governor lever 29 and hence of the quantity adjusting device 28. The deceleration of the vehicle is accordingly largely free of bucking. Once the damping piston 44 has traveled a predetermined displacement distance, the annular groove 63 is uncovered toward the damping chamber 45, thus cancelling the damping action. The further transmission of the restoring motion of the rpm adjusting lever 32 to the governor lever 29 then takes place undamped.

The foregoing relates to a preferred exemplary embodiment of the invention, it being understood that other variants and embodiments thereof are possible within the spirit and scope of the invention, the latter being defined by the appended claims.

what is claimed and desired to be secured by Letters Patent of the Unite States is:

1. A fuel injection pump for Diesel engines provided with a housing having a pump piston, which draws fuel from a fuel-filled pump interior that is at feed pressure and pumps it at high pressure to injection nozzles; a quantity adjusting device the location of which relative to the pump piston determines the fuel injection quantity per pump piston stroke; a two-armed governor lever adapted to engage the quantity adjusting device with one of said arms adapted to actuate said adjusting device and with the other of said arms being coupled via at least one governor spring with an arbitrarily actuatable rpm adjusting lever that is pivotable counter to a restoring spring about a pivot shaft fixed on the pump housing; a damping device, comprising a cylinder for rpm adjustment, a piston and throttle that is axially displaceable in the damping cylinder, said damping device adapted to provide for delayed adjustment of the quantity adjustment device upon rapid actuation of the rpm adjusting lever to thereby improve the smoothness of engine operation, further in which said coupling between the rpm adjusting lever (32) and the governor spring (31) is performed via a pre-stressed drag spring (36), which is supported at one end thereof on the rpm adjusting lever (32) and on the other end thereof on a lever arm of a damper lever (37) which is connected to the governor spring (31), pivotable about a shaft (35) of the rpm adjusting lever (32) and thereby adapted to move the rpm adjusting lever (32) to contact a stop (38) on the damper lever (37) that is pivotably connected to the damping piston (44); said damping piston further including a throttle (47) which connects a damping chamber (45), enclosed by the damping piston (44) and the damping cylinder (41, 42, 43), with the pump interior (11) via a check valve (46) which has an open direction toward the damping chamber (45); and further that throttle (48) is adapted to connect the damping chamber (45) with the pump interior (11) via a further check valve (49) which is blocked toward the damping chamber (45).

2. A fuel injection pump as defined by claim 1, in which unthrottled flow paths (67, 68) are connected parallel to the throttles (47, 48) between the damping chamber (45) and the pump interior (11) in such a manner that they are opened only in portions of the displacement motion of the damping piston (44) in which idle travel of the rpm adjusting lever (32) occurs.

3. A fuel injection pump as defined by claim 2, in which the damping cylinder comprises a damper housing (41) that is closed on both ends, secured in the pump interior (11) a guide sleeve (43) that is axially slidably displaceable in a bore (42) in said damper housing, a damping piston (44) in said guide sleeve, at least one flow path (67) in said damping piston (44) adapted to communicate with a control opening (60) disposed in the guide sleeve (43) and opened toward the pump interior (11), said control opening further adapted to cooperate with a conduit (62) in the damping piston (44) which leads to the damping chamber (45) thereby to block and open up the flow path (67); that one end of the guide sleeve (43), together with the damping piston (44), defines a control chamber (50) which communicates with the pump interior (11) and the other end of the guide sleeve (43) that is covered by a closure plate (52), defines a relief chamber (54) which communicates with a fuel return line (56); and further that a compression spring (53) supported on the closure plate (52) and having means to adjust initial tension thereof is disposed in the relief chamber (54).

4. A fuel injection pump as defined by claim 3, in which the conduit (67) comprises a bypass bore (62) having a mouth portion adapted to bypass the throttle (47) in the damping piston (44), which bypass bore discharges at a distance from a mouth provided in the throttle (47) on the circumference of the damping piston (44), and further that the control opening (60) is of a diameter that is adequate to encompass the respective mouths of the throttle (47) and/or bypass bore (62).

5. A fuel injection pump as defined by claim 3, in which a further flow path (68) comprises an annular groove (63) in the damping chamber (45), which is closed off or opened up after a displacement path of the damping piston (44) relative to the damping chamber (45) that is dependent on the relative position of the guide sleeve (43) and damping piston (44), by a radial bore (65) in the guide sleeve (43) that opens toward the pump interior (11), and by an axial groove (64) in the damping piston (44) that connects the annular groove (63) with the radial bore (65) over the entire displacement path of the damping piston (44).

6. A fuel injection pump as defined by claim 4, in which a further flow path (68) comprises an annular groove (63) in the damping chamber (45), which is closed off or opened up after a displacement path of the damping piston (44) relative to the damping chamber (45) that is dependent on the relative position of the guide sleeve (43) and damping piston (44), by a radial bore (65) in the guide sleeve (43) that opens toward the pump interior (11), and by an axial groove (64) in the damping piston (44) that connects the annular groove (63) with the radial bore (65) over the entire displacement path of the damping piston (44).

7. A fuel injection pump as defined by claim 1, in which the further throttle (48) and the further check valve (49) are disposed in the damper housing (41).

8. A fuel injection pump as defined by claim 2, in which the further throttle (48) and the further check valve (49) are disposed in the damper housing (41).

9. A fuel injection pump as defined by claim 3, in which the further throttle (48) and the further check valve (49) are disposed in the damper housing (41).

10. A fuel injection pump as defined by claim 4, in which the further throttle (48) and the further check valve (49) are disposed in the damper housing (41).

11. A fuel injection pump as defined by claim 5, in which the further throttle (48) and the further check valve (49) are disposed in the damper housing (41).

12. A fuel injection pump as defined by claim 1, in which a third flow path (69) is disposed directly between the damping chamber (45) and the pump interior (11), said third flow path adapted to be controlled by a pressure valve (70), which in turn is controlled by the pressure in the pump interior (11), which is opened above a pressure value in the pump interior (11) that corresponds to higher engine rpm.

13. A fuel injection pump as defined by claim 2, in which a third flow path (69) is disposed directly between the damping chamber (45) and the pump interior (11), said third flow path adapted to be controlled by a pressure valve (70), which in turn is controlled by the pressure in the pump interior (11), which is opened above a pressure value in the pump interior (11) that corresponds to higher engine rpm.

14. A fuel injection pump as defined by claim 3, in which a third flow path (69) is disposed directly between the damping chamber (45) and the pump interior (11), said third flow path adapted to be controlled by a pressure valve (70), which in turn is controlled by the pressure in the pump interior (11), which is opened above a pressure value in the pump interior (11) that corresponds to higher engine rpm.

15. A fuel injection pump as defined by claim 4, in which a third flow path (69) is disposed directly between the damping chamber (45) and the pump interior (11), said third flow path adapted to be controlled by a pressure valve (70), which in turn is controlled by the pressure in the pump interior (11), which is opened above a pressure value in the pump interior (11) that corresponds to higher engine rpm.

16. A fuel injection pump as defined by claim 5, in which a third flow path (69) is disposed directly between the damping chamber (45) and the pump interior (11), said third flow path adapted to be controlled by a pressure valve (70), which in turn is controlled by the pressure in the pump interior (11), which is opened above a pressure value in the pump interior (11) that corresponds to higher engine rpm.

17. A fuel injection pump as defined by claim 6, in which a third flow path (69) is disposed directly between the damping chamber (45) and the pump interior (11), said third flow path adapted to be controlled by a pressure valve (70), which in turn is controlled by the pressure in the pump interior (11), which is opened above a pressure value in the pump interior (11) that corresponds to higher engine rpm.

18. A fuel injection pump as defined by claim 12, in which the pressure valve (70) comprises a slide valve disposed in the damper housing (41), said slide valve having valve connections which communicate on the one hand with the damping chamber (45) and on the other hand with the pump interior (11) and further that a hydraulic control inlet of said pressure valve is connected to the pump interior (11).

19. A fuel injection pump as defined by claim 18, in which the damper housing (41) further includes a blind bore (71), a control piston (73) axially displaceable in said bore, a spring (74) in contact with said control piston (73) and further that the control piston (73) has a control groove (77), which in order to open or close flow path (69) cooperates with two radial control bores (75, 76) which are adapted to discharge diametrically in the blind bore (71), one of which control bores is arranged to communicate with the pump interior (11) and the other with the damping chamber (45).

20. A fuel injection pump as defined by claim 9, in which damper housing (41) has an end portion which receives the compression spring (74), said end portion adapted to communicate via a relief bore (72) with the relief chamber (54) in the damper housing (41).

* * * * *